US008141752B2

(12) United States Patent
Weiss et al.

(10) Patent No.: US 8,141,752 B2
(45) Date of Patent: Mar. 27, 2012

(54) HAND-HELD APPLICATOR UNIT

(75) Inventors: Marianne Weiss, Schwindegg (DE); Stefan Gumpp, Ampfing (DE); Ingo Dunker, Velden (DE)

(73) Assignee: NETZSCH-Mohnopumpen GmbH (DE)

( * ) Notice: Subject to any disclaimer, the term of this patent is extended or adjusted under 35 U.S.C. 154(b) by 922 days.

(21) Appl. No.: 12/175,179

(22) Filed: Jul. 17, 2008

(65) Prior Publication Data

US 2009/0020564 A1 Jan. 22, 2009

(30) Foreign Application Priority Data

Jul. 17, 2007 (DE) ..... 10 2007 033 137

(51) Int. Cl.
*B65D 88/54* (2006.01)

(52) U.S. Cl. ..... 222/324; 222/61; 222/63; 222/146.1; 222/261; 222/333; 222/413; 222/566

(58) Field of Classification Search ..... 222/390, 222/333, 146.1, 52, 146.2, 61, 146.5, 63, 222/323–324, 527, 529, 566, 373, 394, 261–263, 413

See application file for complete search history.

(56) References Cited

U.S. PATENT DOCUMENTS

| | | | | |
|---|---|---|---|---|
| 3,662,927 | A * | 5/1972 | Cocks | 222/146.5 |
| 4,096,973 | A * | 6/1978 | Checko | 222/146.5 |
| 4,285,446 | A * | 8/1981 | Rapp et al. | 222/639 |
| 5,188,259 | A | 2/1993 | Petit | |
| 6,412,662 | B1 * | 7/2002 | Bryan et al. | 222/146.5 |
| 6,527,142 | B1 * | 3/2003 | Ikushima | 222/61 |
| 6,769,578 | B1 | 8/2004 | Ciofalo et al. | |

FOREIGN PATENT DOCUMENTS

| | | | |
|---|---|---|---|
| DE | 1916100 | A1 | 10/1970 |
| EP | 0289882 | A1 | 11/1988 |
| EP | 1083005 | A2 | 3/2001 |
| EP | 0773839 | B1 | 5/2002 |

* cited by examiner

*Primary Examiner* — Frederick C. Nicolas
(74) *Attorney, Agent, or Firm* — St. Onge Steward Johnston & Reens LLC

(57) ABSTRACT

The invention relates to a hand-held applicator unit for viscous materials having a screw pump disposed in a pump casing which is in communication with a drive, wherein the pump inlet has a product intake with a flexible supply line and the pump outlet contains a shaped mouthpiece.

14 Claims, 1 Drawing Sheet

HAND-HELD APPLICATOR UNIT

CROSS-REFERENCE TO RELATED APPLICATIONS

The present application claims priority of German patent application No. 10 2007 033 137.3 filed on Jul. 17, 2007, the content of which is incorporated herein by reference.

FIELD OF THE INVENTION

The invention relates to a hand-held applicator unit for viscous materials.

BACKGROUND OF THE INVENTION

An applicator device according to the invention, as shown in EP 0773 839 B1, has a casing to which a handle is affixed, which accommodates a switch for the drive therein. Located on the casing is a feed container with a mixing paddle. The feed container opens directly into a feed screw having a large feed volume. A feed screw having smaller dimensions is mounted adjacent to this feed screw, by which means the product to be processed can be finely metered.

The object of the invention is to improve a hand-held applicator unit with regard to handling properties.

SUMMARY OF THE INVENTION

The object is achieved by provision of a hand-held applicator unit for viscous materials according to a first embodiment of the present invention. The hand-held applicator unit comprises a screw pump disposed in a pump casing which is in communication with a drive. The pump inlet comprises a product intake with a flexible supply line and the pump outlet contains an applicator nozzle. The handle comprises a pressure sensor for controlling a material supply.

In one inventive embodiment of the hand-held applicator unit, the product intake of the pump inlet is provided with a flexible supply line. By this means the moveability of the applicator unit is increased. The product inlet advantageously additionally has a ball joint which again improves the transition from the flexible supply line to the hand-held applicator unit in terms of its mobility. The ball joint avoids the supply line from being exposed to undesired torsional forces and the operator of the hand-held applicator unit being restricted in his freedom of movement.

In order to simplify the structure of the hand-held applicator unit, the eccentric screw pump integrated in the unit has as few components as feasible. Thus, the actual pump casing consists of two clamping parts which can be clamped or screwed to one another. Located inside these clamping parts are the stator with its stator cladding not shown in detail and the rotor revolving eccentrically therein. Likewise surrounded by a clamping part is the joint/s or an elastic coupling rod.

In order that the hand-held applicator unit manages with as few as possible additional, possibly even external components, the pressure sensor that measures the pressure of the medium in the pump casing is inserted in the hand-held applicator unit. The pressure sensor can be actuated by a switch in the handle of the hand-held applicator unit for which the pressure sensor is placed in the handle. For this purpose the pressure sensor is integrated directly in the handle.

The side of the pressure sensor having the membrane for detecting the pressure in the pump casing is located in the inner wall of one of the clamping parts for the stator.

As a result of the different viscosity that the product may have on entering the pump and which it must have in order to be optimally processed, an electrical heater in the form of a heating mat is located between the eccentric screw pump and the casing. The temperature control of the product makes it possible to process liquid up to 10 million mPas. The metering volumes can be selected from about 0.075 ml per cycle and from about 1.20 ml/min by means of control units.

For the purpose of applying product to problem locations or simpler guidance of the hand-held applicator unit, a specially shaped, e.g. angled, applicator nozzle can be attached at the outlet of the unit, which can be varied in its position by means of quick-clamping elements.

BRIEF DESCRIPTION OF THE DRAWINGS

The invention is explained in detail with reference to an exemplary embodiment. In the figures.

DETAILED DESCRIPTION OF THE INVENTION

Figure 1:
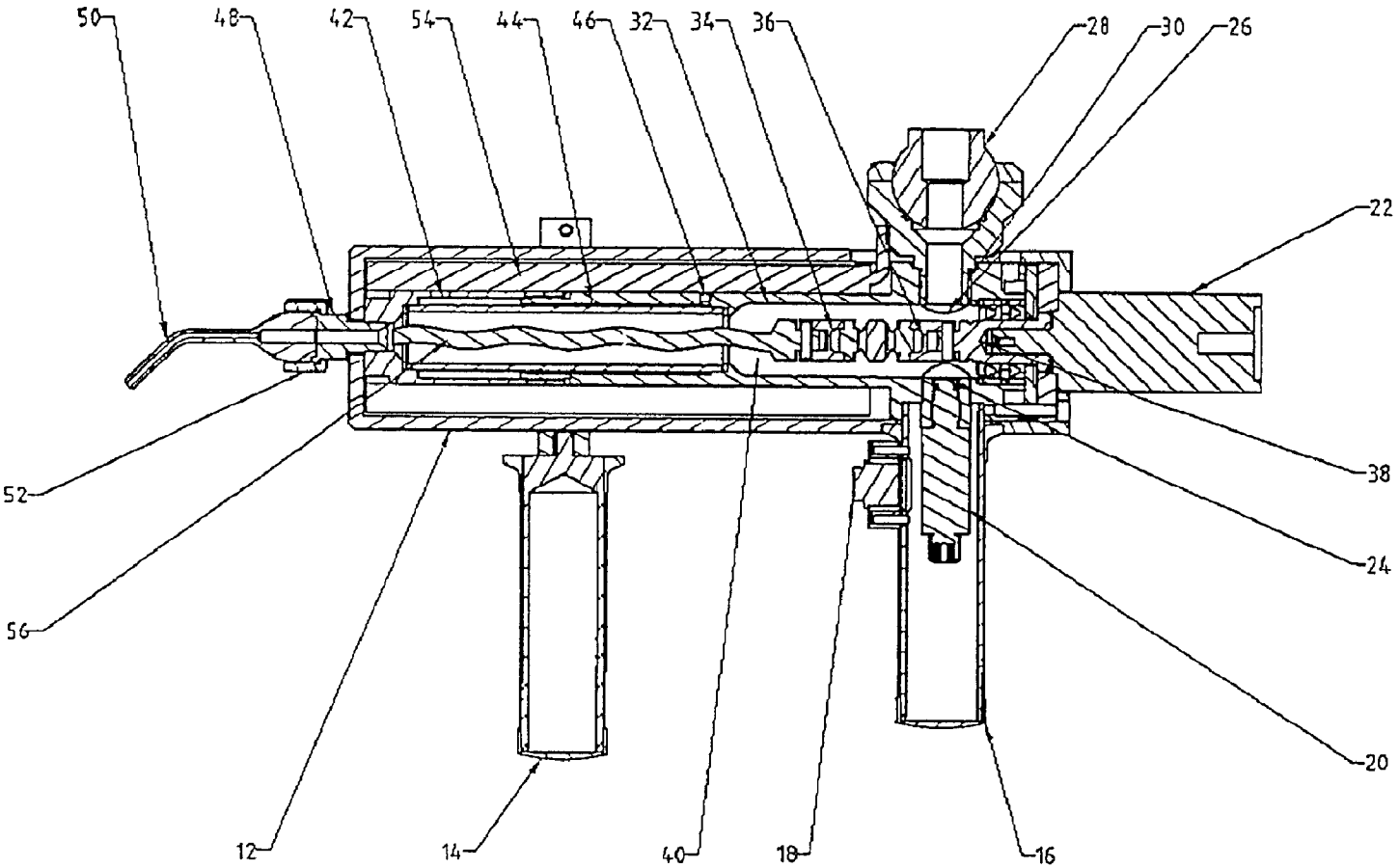
FIG. 1 shows a sectional view of a hand-held applicator unit.

The hand-held applicator unit 10 shown in FIG. 1 is used for applying viscous materials to various objects. For exact positioning and handling of the hand-held applicator unit 10, a front handle 14 and a rear handle 16 are affixed to the casing 12. The task of the front handle 14 merely consists in stabilising the hand-held applicator unit in its respective place of usage. The rear handle 16 which is affixed to the pump casing 38 fulfils several tasks simultaneously. It serves as a handle for positional stabilisation and at the same time it accommodates a switch 18 and a pressure sensor 20 therein or thereon. The switch 18 actuates a drive 22 which can be of an electric or pneumatic type. The pressure sensor 20 senses with its membrane 24 which sits opposite the product inlet 26 to see whether sufficient product is supplied. If the pressure of the product does not reach the required pressure value, the electric/electronic circuit pertaining to the hand-held applicator unit switches a signal as a result of which more product is supplied from the feed container or the available empty container is exchanged for a full feed container.

In order to fully maintain the feeding of the product in any vertical or horizontal position of the hand-held applicator unit, the transition from the feed pipe to the housing 12 consists of a ball joint 28. The ball joint 28 is fixed in the pump casing 38 by means of a thread 30. The end pieces of the ball joint 28 and its pipe connecting piece open in the area of the joints 34, 36 and the end of the drive shaft into the pump inlet chamber 40. As a result of the radial and axial moveability of the ball joint, bending of the product supply line can be avoided.

The core piece of the hand-held applicator unit, the metering pump, is composed of two clamping parts 32, 42 which accommodate an eccentric screw pump, shown in part, in their interior. By means of the positive threaded connection between the clamping parts 32, 42, the stator 44 of the eccentric screw pump can easily be exchanged without major assembly expenditure. At both ends of the stator region, the clamping parts have holes 46 for securing the stator against twisting.

The clamping part 42 located on the pressure side end of the hand-held applicator unit is connected to the applicator nozzle 50 by means of an adapter 48. The position/location of the applicator nozzle 50 can be corrected by turning the clamping nut 52.

A heating and cooling chamber 54 is located between the housing 12 of the hand-held applicator unit and the pump casing 32, 42. Depending on the particular usage for which the hand-held applicator unit is required, the heating and cooling chamber can accommodate a coolable or heatable battery or merely a heating mat.

What is claimed is:

1. A hand-held applicator unit for viscous materials comprising: a handle; and a screw pump disposed in a pump casing which is in communication with a drive, wherein the pump net comprises a product intake with a flexible supply line and the pump outlet contains an applicator nozzle; wherein the handle comprises a pressure sensor for controlling a material supply.

2. The hand-held applicator unit according to claim 1, wherein a stator of the screw pump is disposed between two clamping parts connected axially to one another.

3. The hand-held applicator unit according to claim 2, wherein the screw pump comprises an eccentrically revolving rotor.

4. The hand-held applicator unit according to claim 2, wherein a clamping part accommodates one or more joints.

5. The hand-held applicator unit according to claim 2, wherein the clamping part articulates and is in communication with the product intake.

6. The hand-held applicator unit according to claim 5, wherein the pump net comprises a ball joint having a product supply line joined to a joint ball thereof.

7. The hand-held applicator unit according to claim 6, wherein the handle is affixed to the pump casing and is provided diametrically to the ball joint.

8. The hand-held applicator unit according to claim 7, wherein the handle comprises a switch which switches on and off the drive.

9. The hand-held applicator unit according to claim 2, wherein a cooling or heating chamber extends between an insulating casing and the clamping parts.

10. The hand-held applicator unit according to claim 9, wherein a heating mat is disposed in the heating chamber.

11. The hand-held applicator unit according to claim 1, wherein a rotatable applicator nozzle sits on the pump outlet.

12. The hand-held applicator unit according to claim 11, wherein the applicator nozzle has a curvature.

13. The hand-held applicator unit according to dam 1, wherein a membrane of the pressure sensor is located in an area of the pump inlet.

14. The hand-held applicator unit according to claim 13, wherein a cable run from and to a switch and from and to the pressure sensor runs inside the handle and inside casing parts.

* * * * *